US006357897B1

(12) United States Patent
Shih

(10) Patent No.: US 6,357,897 B1
(45) Date of Patent: Mar. 19, 2002

(54) SIDELESS COLLAPSIBLE FRAME LAMPSHADE

(76) Inventor: Wen-Shown Shih, No. 9-1, Hsing Yi Road, Taipei City (TW)

( * ) Notice: Subject to any disclaimer, the term of this patent is extended or adjusted under 35 U.S.C. 154(b) by 0 days.

(21) Appl. No.: 09/526,081

(22) Filed: Mar. 15, 2000

(51) Int. Cl.[7] ..... F21V 17/06

(52) U.S. Cl. ..... 362/434; 362/356; 362/357; 362/352

(58) Field of Search ..... 362/434, 352, 362/356, 357, 449, 450

(56) References Cited

U.S. PATENT DOCUMENTS 4,383,291 A * 5/1983 Gall ..... 362/352

5,375,048 A * 12/1994 Barnes ..... 362/352

* cited by examiner

*Primary Examiner*—Sandra O'Shea
*Assistant Examiner*—Ronald E. DelGizzi
(74) *Attorney, Agent, or Firm*—Rosenberg, Klein & Lee

(57) ABSTRACT

A sideless collapsible frame lampshade wherein two upper and lower circular frames are utilized as the top and bottom structural elements on which a pliant material is installed and held taut by means of a middle frame that allows for convenient assembly and disassembly, while reinforcing the separation of the upper and lower circular frames to thereby form a collapsible lampshade structure that does not require lateral frame members.

3 Claims, 9 Drawing Sheets

SIDELESS COLLAPSIBLE FRAME LAMPSHADE

BACKGROUND OF THE INVENTION

1) Field of the Invention

The invention herein relates to a sideless collapsible frame lampshade wherein two upper and lower circular frames are utilized as the top and bottom structural elements on which a pliant material is installed and held taut by means of a middle frame that reinforces the separation of the upper and lower circular frames to thereby form a collapsible lampshade structure that does not require lateral frame members.

2) Description of the Prior Art

Current conventional lampshades are fabricated of a hard material uititarily formed into a certain shape or of rigid materials that function as frame members on which a pliant material is installed to construct lampshades of various shapes; as indicated in FIG. 1, FIG. 2, FIG. 3, and FIG. 4, the conventional table lamp 10 has a socket pipe 12 projecting from the center of a lamp base 11 and the lampshade 13 is comprised of a lower circular frame 131, an upper circular frame 132, and a plurality of lateral frame members 133 distributed in between and conjoining the two upper and lower frames; a support ring 134 is situated at the center of the lower circular frame 131, with a plurality of the coupling frame members 135 conjoining it to the upper circular frame 132; a pliant material 14 enshrouded over the two upper and lower frames and, furthermore, draped over the lateral frame members 133 to form a permanent lampshade 13 structure; the support ring 134 of the said lampshade 13 is directly sleeved over the tip of the socket pipe 12 and thereby installed to the lamp base 11 to complete the assembly of a table lamp 10 structure. In another conventional table lamp 20, the socket pipe 22 projects from the center of a lamp base 21 and a tubular U-shaped fixture 23 is supported in a saddle mount 211 horizontally inserted through the lower extent of the said socket pipe 22 and the said fixture 23 is of a narrow gauge and bent into curve, with a stud 231 disposed at the center of its top extent and insertion ends 232 at the bottom two sides such that the insertion ends 232 of the said fixture 23 can be placed into the saddle mount 221; the lampshade 24 is comprised of a lower circular frame 241 and an upper circular frame 242 and a plurality of lateral frame members 245 distributed in between and conjoining the two upper and lower frames; furthermore, a support ring 244 is situated at the center of the upper circular frame 242, with a plurality of coupling frame members 243 conjoining it to the upper circular frame 132 and then a pliant material 25 enshrouded over the two upper and lower frames and, furthermore, draped over the lateral frame members 245 to form a permanent lampshade 24 structure; the stud 231 at the top of the fixture 23 is inserted into the lampshade 24 support ring 244 to complete the assembly of a table lamp 20 structure. Referring to FIG. 2 and FIG. 4, the said pliant material 14 and 25 is not shown to more clearly depict the internal structure of the said lampshades 13 and 24.

In the structures of the said conventional lampshades 13 and 24, rigid materials serve as structural members, with the pliant material installed on the structural members to fabricate lampshades of fixed shape; the shortcomings are that since considerable material is utilized to craft the structural members and, furthermore, the two upper and lower frames must be conjoined together by means of lateral frame members, the greater fabrication process and time involved increases the overall production cost; furthermore, since the conventional lampshades are of invariable shape and physical dimensions, the shipping cubic dimensions are larger and, furthermore, stacking without readily incurring damage is not possible, shipping costs are also higher. In view of the existent technological problems of conventional lampshade structures, the inventor of the invention herein conducted extensive research and innovated numerous improvements which culminated in the successful development of several collapsible lampshade structures that do not require lateral frame members, thereby thoroughly eliminating the drawbacks of the conventional products.

SUMMARY OF THE INVENTION

Therefore, the objective of the invention herein is to provide a sideless collapsible frame lampshade wherein two upper and lower circular frames are utilized as the upper and lower structural elements on which a pliant material is installed and held taut by means of a middle frame that reinforces the separation of the upper and lower circular frames to thereby form a collapsible lampshade structure that does not require lateral frame members and, since the middle frame allows for simple assembly and disassembly, the present invention is of an improved structure that minimizes packaging dimensions, reduces shipping costs, and facilitates efficient storage.

To enable the examination committee to further understand the advantageous structural features and innovative content of the invention herein, the brief description of the drawings below is followed by the detailed description of the embodiments.

DETAILED DESCRIPTION OF THE EMBODIMENTS

Figure 1:
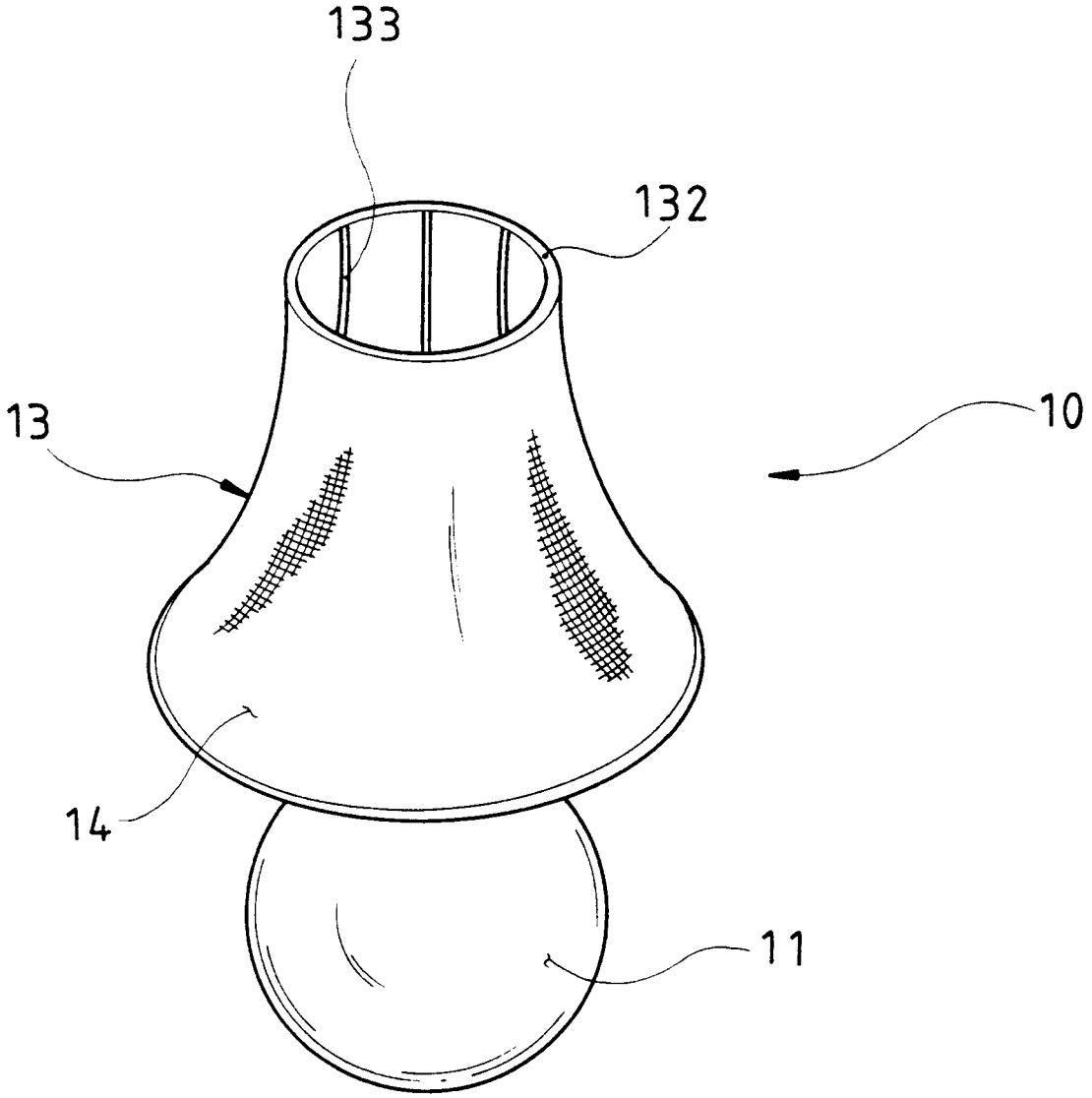
FIG. 1 (PRIOR ART)
FIG. 1 is an isometric drawing of a conventional table lamp 10.
Figure 2:
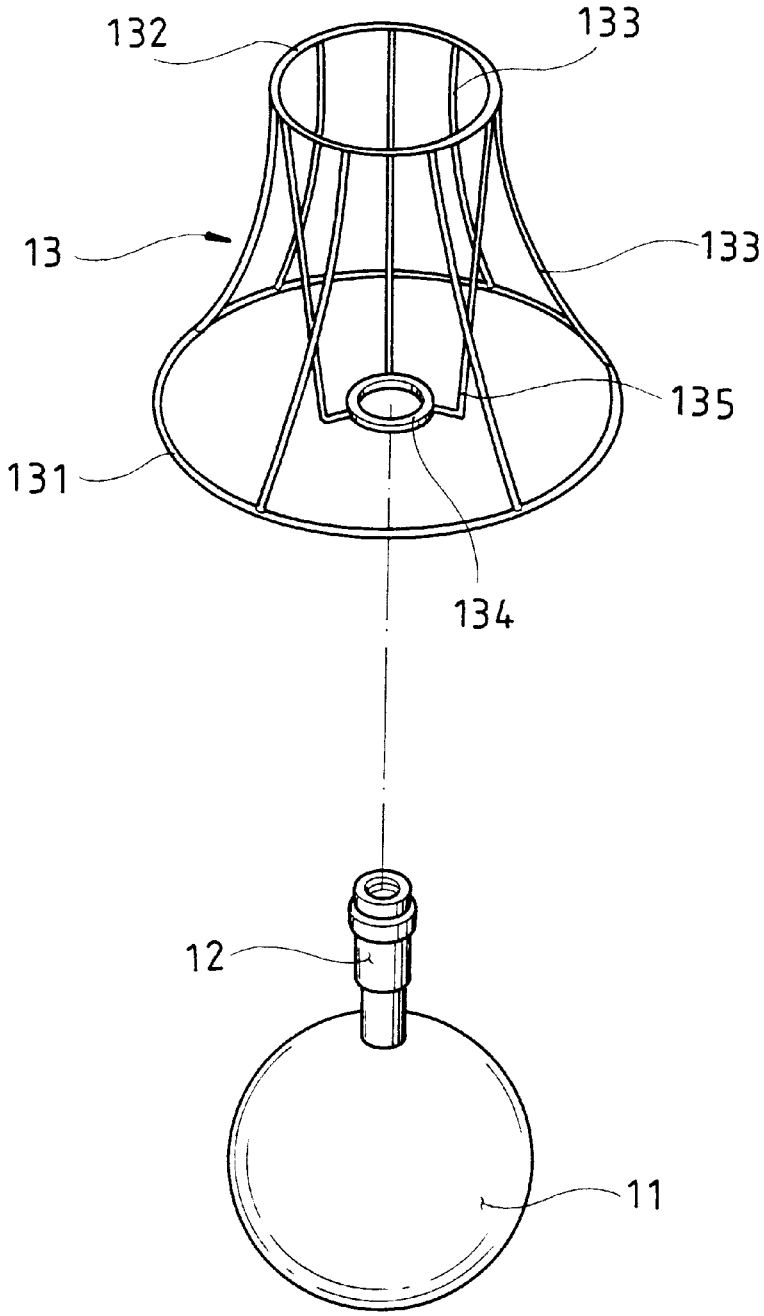
FIG. 2 (PRIOR ART)
FIG. 2 is an isometric drawing of a conventional lampshade structure 13.
Figure 3:
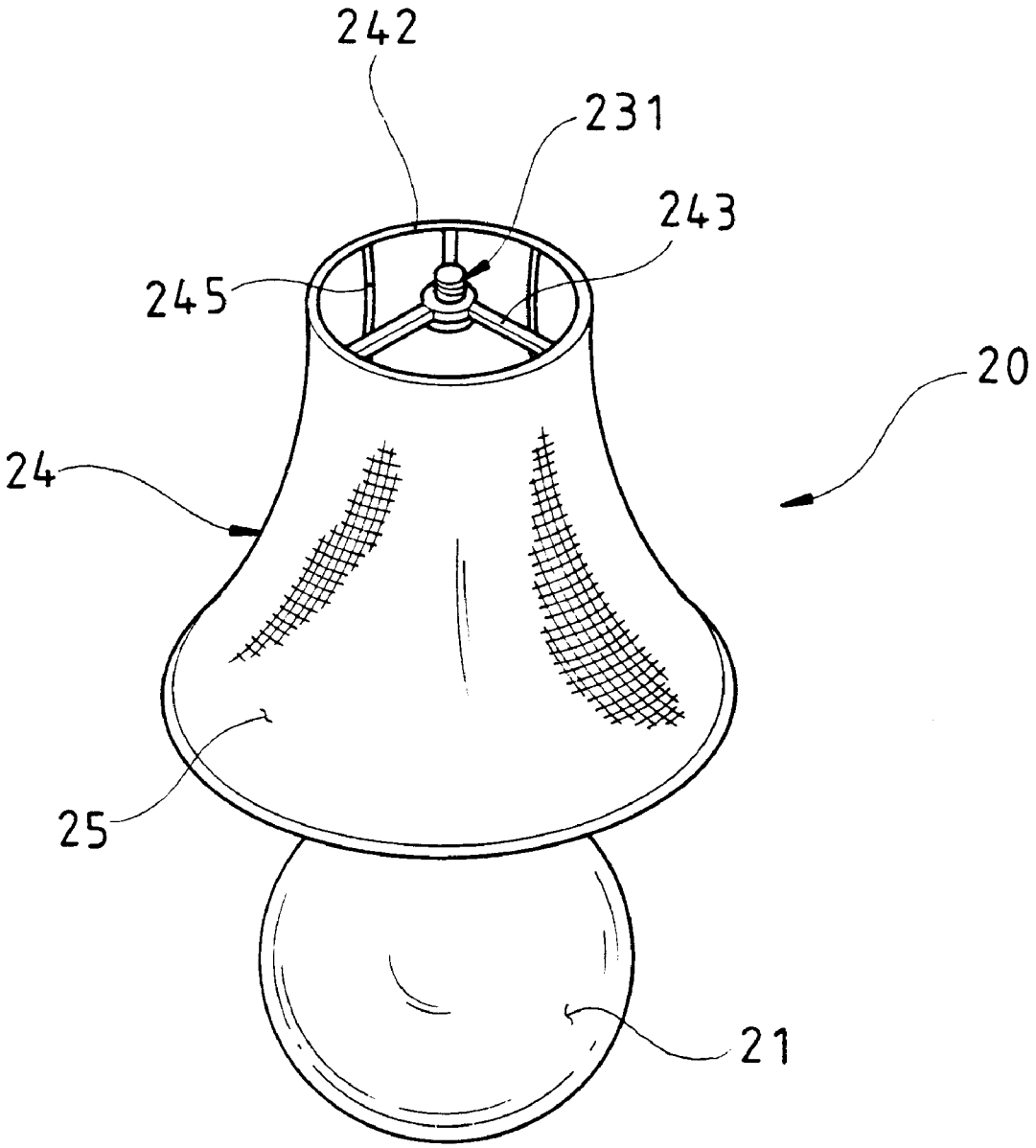
FIG. 3 (PRIOR ART)
FIG. 3 is an isometric drawing of a conventional table lamp 20.
Figure 4:
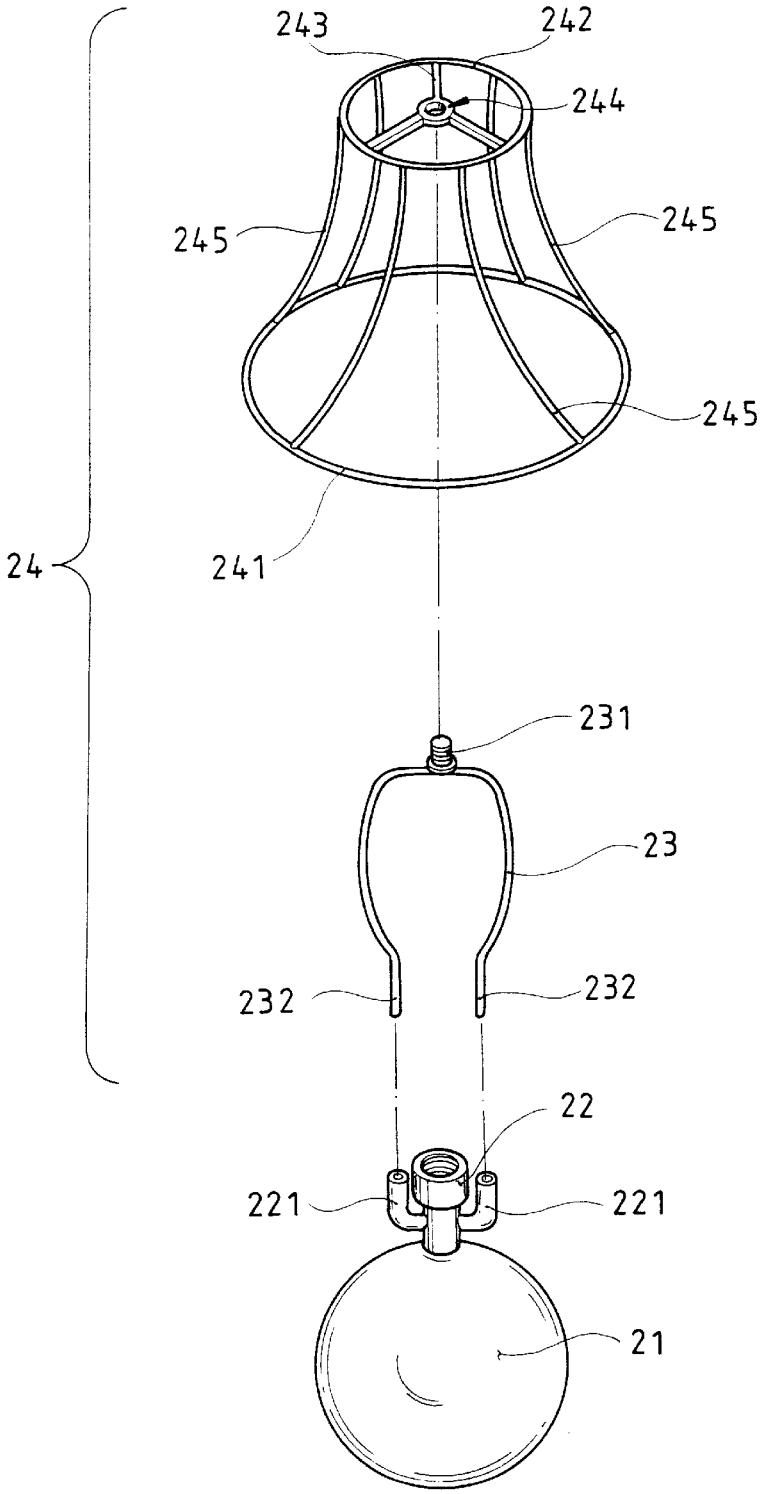
FIG. 4 (PRIOR ART)
FIG. 4 is an isometric drawing of a conventional lampshade structure 24.
Figure 5:
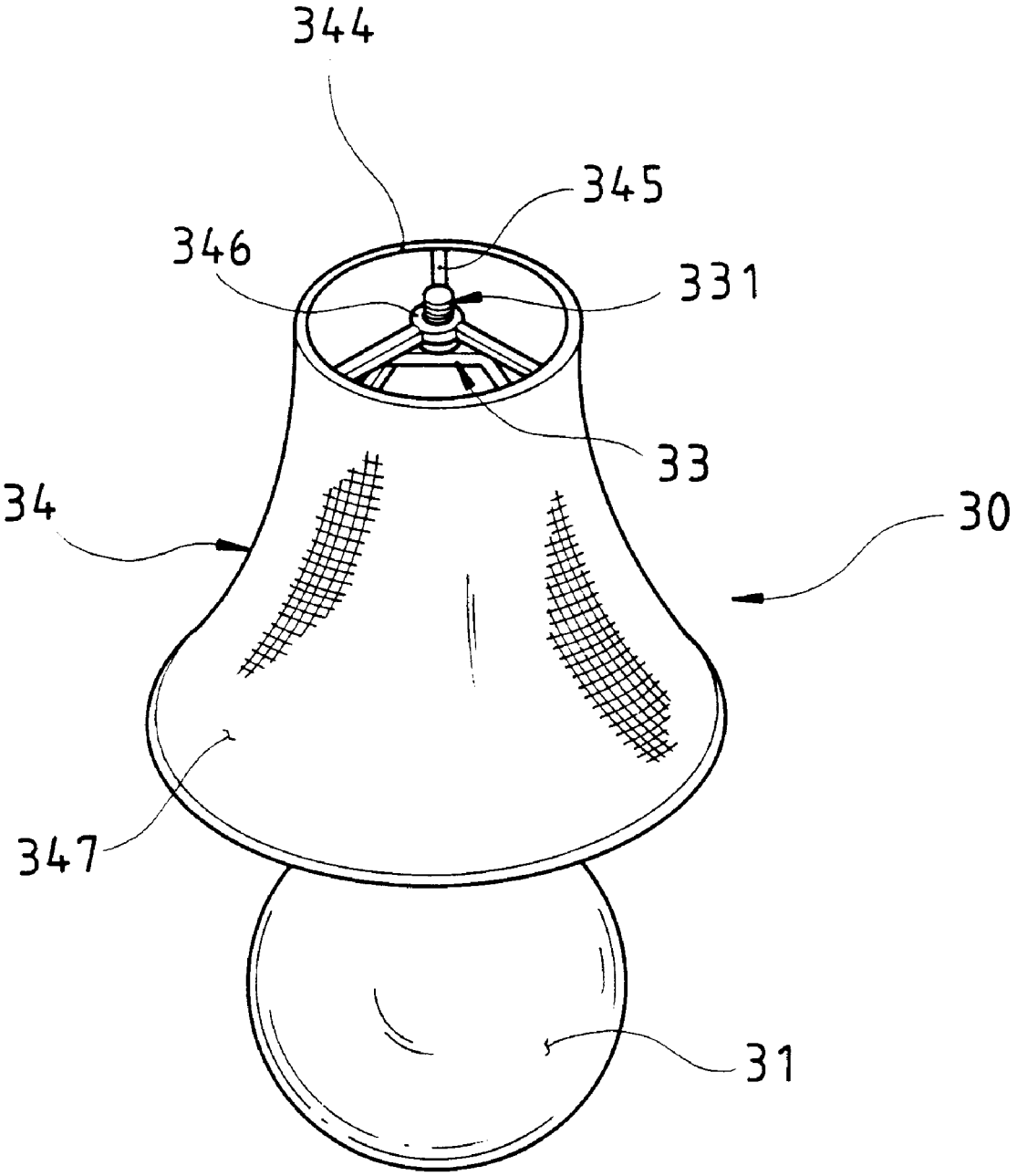
FIG. 5 is an isometric drawing of the table lamp 30 of the invention herein.
Figure 6:
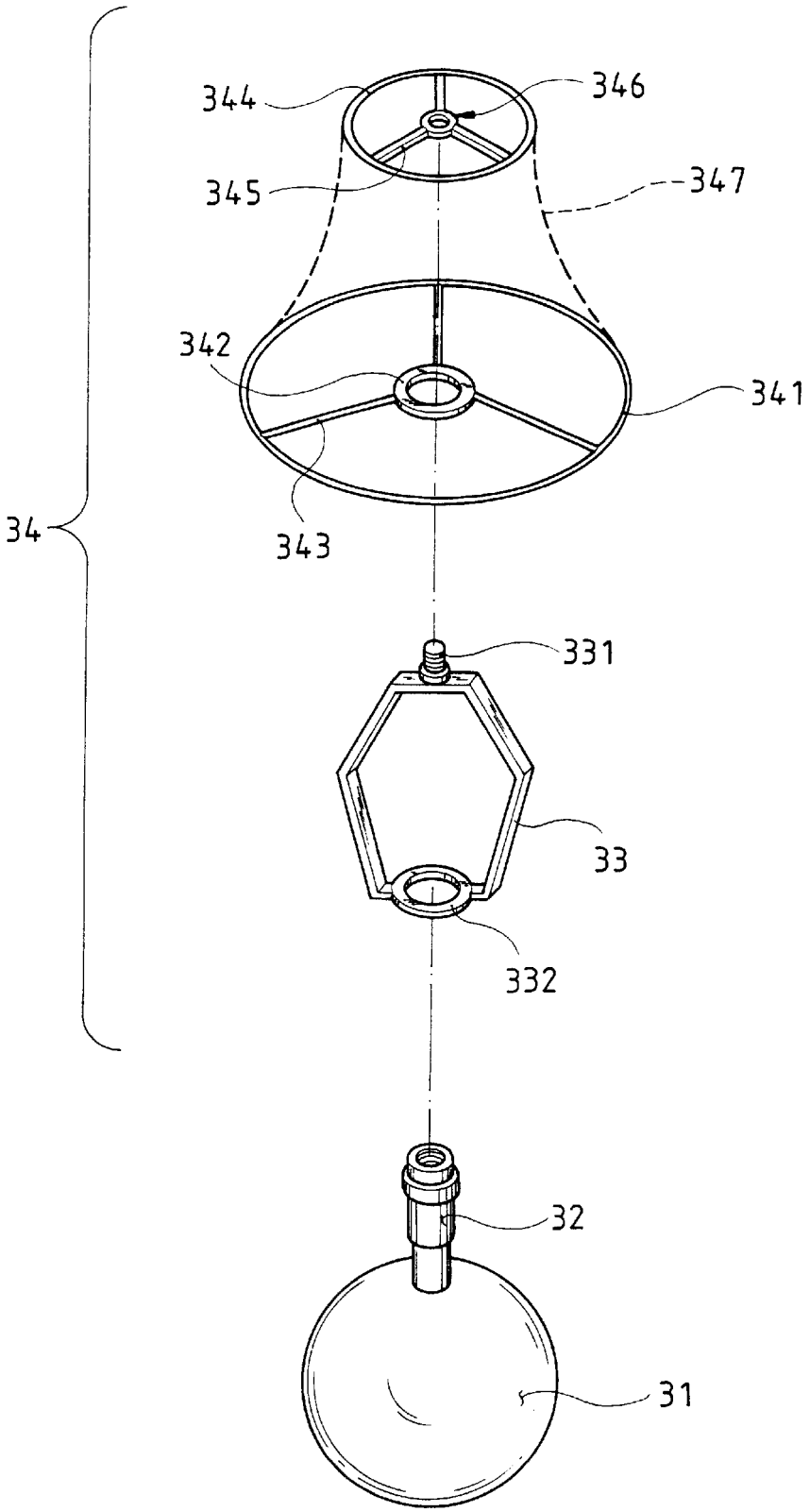
FIG. 6 is an exploded drawing of the lampshade 34 of the invention herein.

The invention herein is a sideless collapsible frame lampshade and, as indicated in FIG. 5 and FIG. 6, the said lampshade 34 is situated on a socket pipe 32 projecting from the center of a lamp base 31, with the said lampshade 34 comprised of a lower circular frame 341, an upper circular frame 344, a middle frame 33, and a pliant material 347, wherein a plurality of contiguous frame members 343 conjoined to a support ring 342 are centered within and affixed to the inner circumference of the said lower circular frame 341, a plurality of contiguous frame members 345 conjoined to a support ring 346 are centered within and affixed to the inner circumference of the said upper circular frame 344, and the said pliant material 347 is enshrouded between the upper circular frame 344 and the lower circular frame 341 to thereby form a hollow lampshade body; the said middle frame 33 is a closed-type arrangement of one-piece construction having a stud 331 disposed at the center of the top side and a support ring 332 formed at the center of the bottom side; the stud 331 at the top of the middle frame 33 is first inserted through the support ring 346 at the center of the upper circular frame 344 and then the support ring 332 at the bottom of the middle frame 33 is placed onto the support ring 342 at the center of the lower circular frame 341 to reinforce the separation of the upper and lower circular frames 344 and 341, causing the pliant material 347 to become taut and thereby constituting the sideless collapsible lampshade structure of the invention herein. Then, the lower circular frame 341 support ring 342 of the finished lampshade 34 is directly ensleeved over the socket pipe 32 and assembled to the lamp base 31 to complete a table lamp 30.

Figure 7:
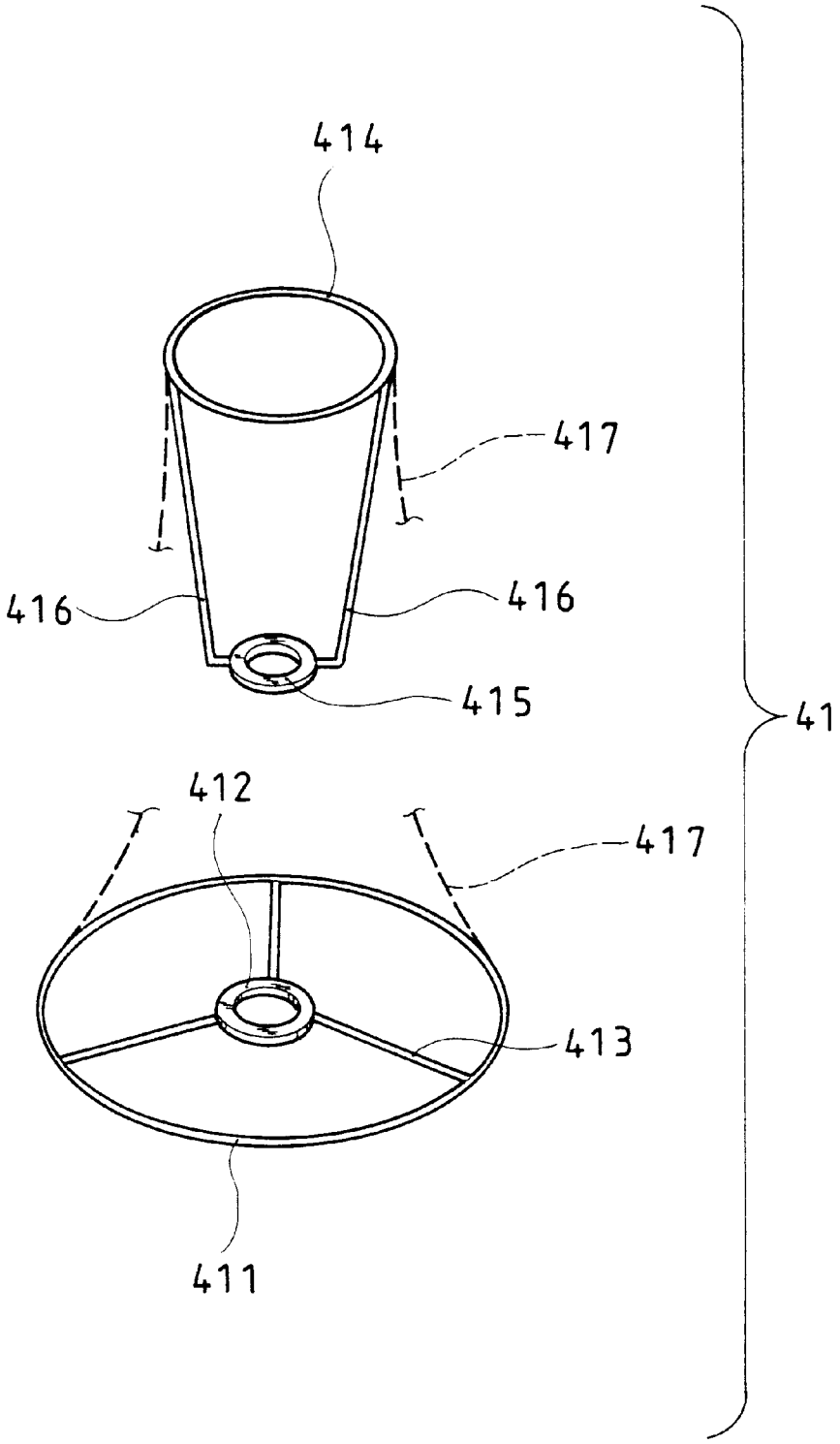
FIG. 7 is an exploded drawing of the lampshade 41 of the invention herein.

Referring to FIG. 7, another lampshade 41 embodiment of the invention herein, the lower circular frame 411 of the said lampshade 41 has a plurality of contiguous frame members 413 conjoined to a support ring 412 centered within and affixed to its inner circumference and the upper circular frame 414 consists of contiguous frame members 416 extending down the two sides and conjoined to a supporting 415; the pliant material 417 is enshrouded between the upper circular frame 414 and the lower circular frame 411 to thereby form a hollow lampshade body; the height between the said support ring 415 and upper circular frame 414 is slightly greater than the height between the upper circular frame 414 and the lower circular frame 411; thus, in terms of utilization, the upper circular frame 414 support ring 415 is placed onto the support ring 412 at the center of the lower circular frame 411, with the reinforced verticality of the upper and lower circular frames 414 and 411 causing the pliant material to become taut, thereby constituting the sideless collapsible lampshade structure of the invention herein.

Figure 8:
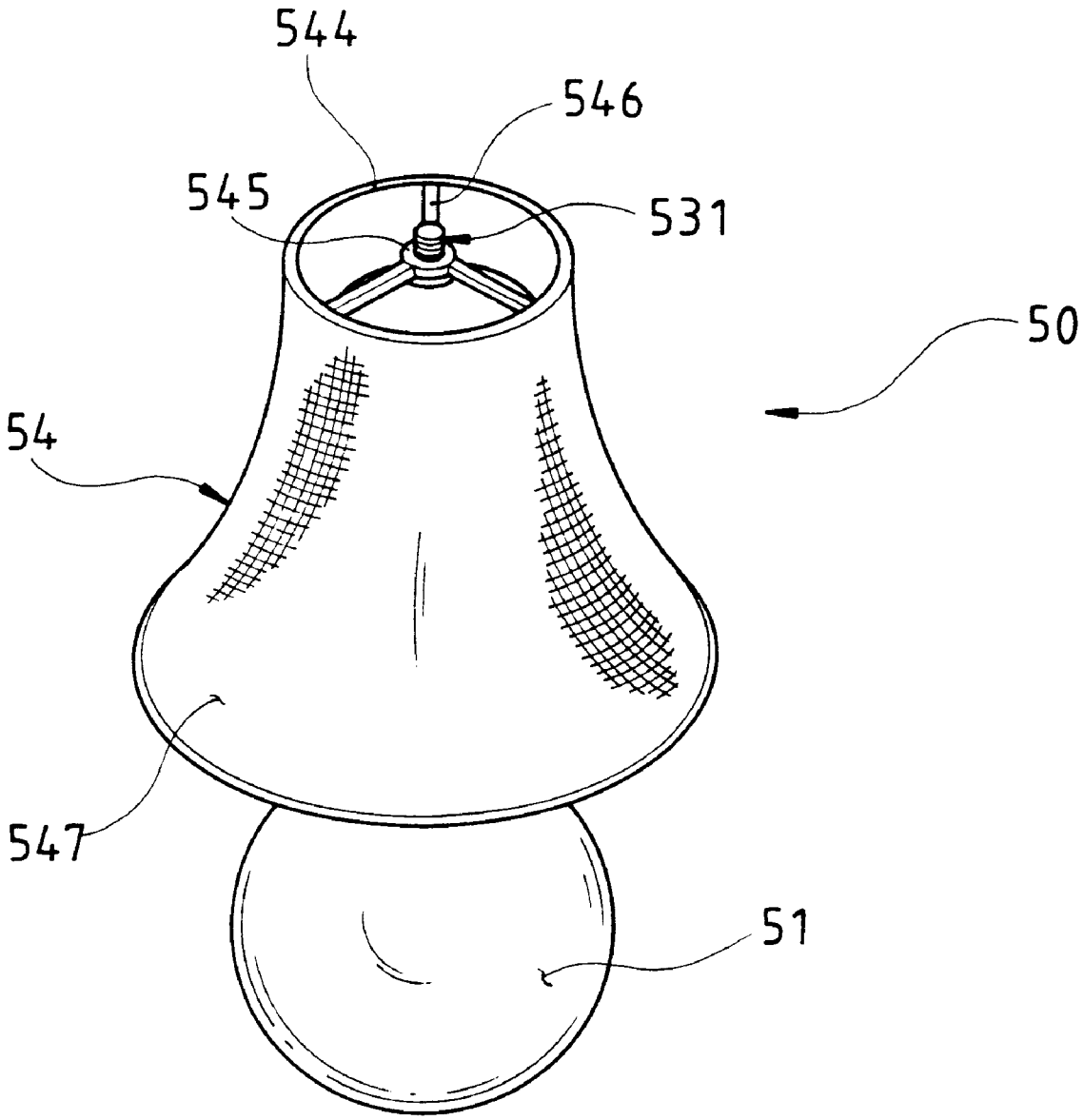
FIG. 8 is an isometric drawing of the table lamp 50 of the invention herein.
Figure 9:
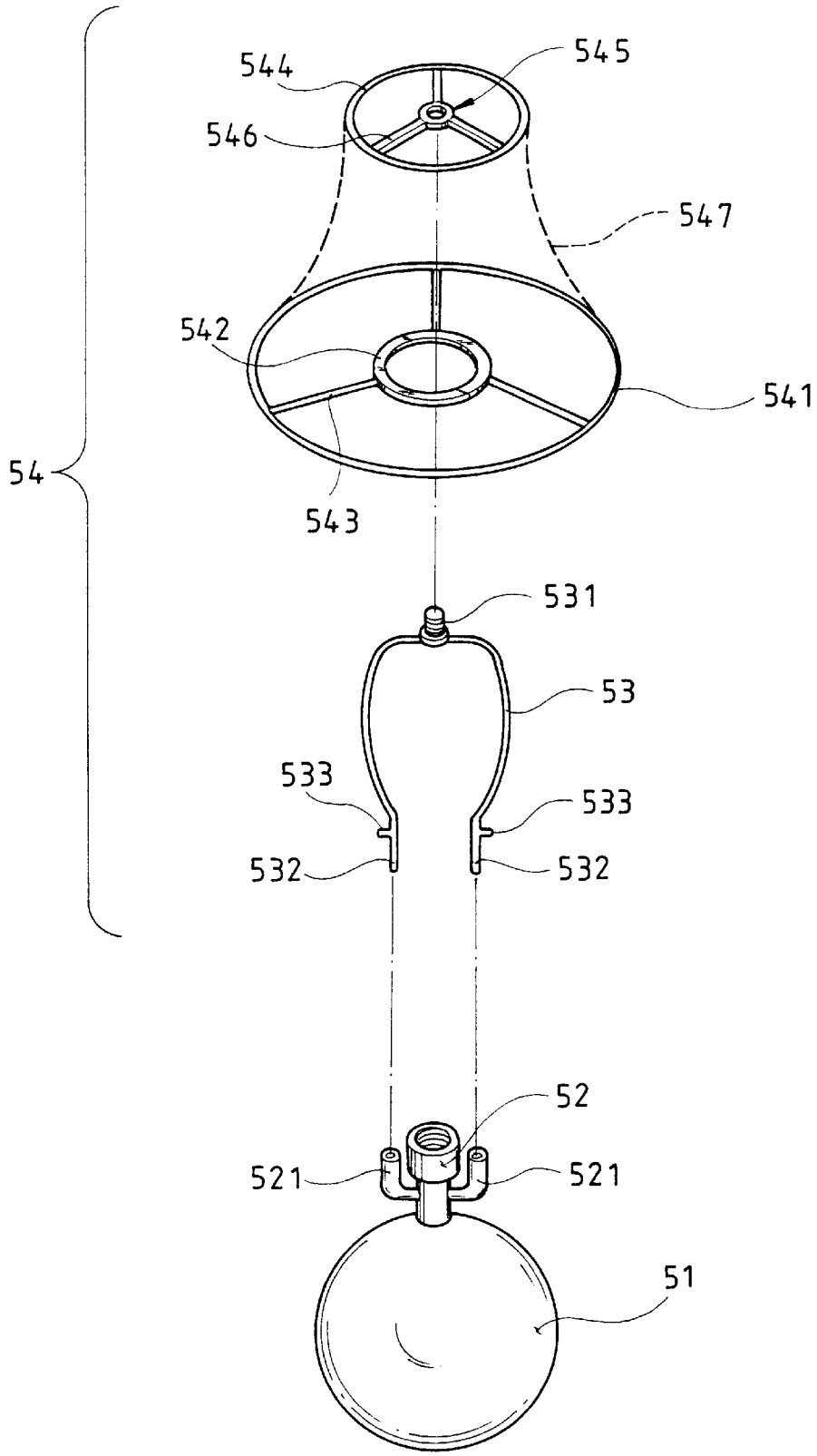
FIG. 9 is an exploded drawing of the lampshade 54 of the invention herein.

Referring to FIG. 8 and FIG. 9, another lampshade 54 embodiment of the invention herein, the said lampshade 54 is comprised of a lower circular frame 541, an upper circular frame 544, a middle frame 53, and a pliant material 547, wherein a plurality of contiguous frame members 543 conjoined to a support ring 542 are centered within and affixed to the inner circumference of the said lower circular frame 541 and a plurality of contiguous frame members 546 conjoined to a support ring 545 are centered within and affixed to the inner circumference of the said upper circular frame 544, and the said pliant material 347 is enshrouded between the upper circular frame 544 and the lower circular frame 541 to thereby form a hollow lampshade body; the said middle frame 53 consists of a narrow-gauge rod bent into curved profile, with a stud 531 disposed at the center of the top side, insertion ends 532 formed at the bottom two sides, and a transverse post 533 protruding laterally from the each of the said insertion ends 532; the stud 531 at the top of the middle frame 53 is first inserted through the support ring 545 at the center of the upper circular frame 544 and then the transverse posts 533 at the bottom of the middle frame 53 is placed onto the support ring 542 at the center of the lower circular frame 541 to reinforce the separation of the upper and lower circular frames 544 and 541, causing the pliant material 547 to become taut and thereby constituting the sideless collapsible lampshade structure of the invention herein. In the table lamp 50 of the invention herein, a socket pipe 52 projects from the center of a lamp base 51 and a tubular U-shaped fixture supporting a saddle mount 521 on each end is horizontally inserted through the lower extent of the said socket pipe 52 such that the said lampshade 54 is assembled to lamp base 51 by respectively slipping the insertion ends 532 at the bottom two sides of the middle frame 53 into the saddle mounts 521 to complete the table lamp 50 structure.

Advantages and Function of the Invention

In the invention herein, the structural features of the said sideless collapsible frame lampshade only involves the fabrication of the two upper and lower circular frames and does not require the constructing of permanent lateral frame members and, furthermore, the pliant material is directly installed over the two upper and lower circular frames, with the middle frame utilized to rapidly stabilize and reinforce the pliant material into a taut state to form the lampshade; since the middle frame allows for convenient assembly and disassembly, the collapsible lamp shade structure minimizes packaging dimensions and reduces shipping costs. Furthermore, if the two upper and lower circular frames are changed in shape (such as into an hexagonal, a quadrilateral, or an octagonal shape, etc.), the lamp base and the middle frame do not have to modified to achieve a different overall lampshade profile, while providing for additional new model and production flexibility.

In summation of the foregoing section, since the invention herein is capable of achieving the claimed utility and functions and the disclosed structure has superior practical value and functionality and, furthermore, an identical or similar article has never been observed on the market, therefore, the present invention meets new patent application requirements and is hereby submitted to the examination committee for review and the granting of the commensurate patent rights.

What is claimed is:

1. A sideless collapsible frame lampshade comprised of: a lower circular frame, an upper circular frame, a middle frame, and a pliant material, wherein a plurality of contiguous frame members conjoined to a support ring are centered within and affixed to the inner circumference of the said lower circular frame, a plurality of contiguous frame members conjoined to a support ring are centered within and affixed to the inner circumference of the said upper circular frame, and the said pliant material is enshrouded between the said upper circular frame and the said lower circular frame to thereby form a hollow lampshade body; the said middle frame comprises a closed arrangement of one-piece construction having a stud disposed at the center of the top side and a support ring formed at the center of the bottom side; the said stud at the top of the said middle frame is first inserted through the said support ring at the center of the said upper circular frame and then the said support ring at the bottom of the said middle frame is placed onto the said support ring at the center of the said lower circular frame to reinforce the separation of the two said upper and lower circular frames, causing the said pliant material to become taut and thereby constituting the sideless collapsible lampshade structure of the invention herein.

2. The sideless collapsible frame lampshade of claim 1, wherein, the top of the said middle frame can be connected to the said upper circular frame to form a one-piece structural member.

3. The sideless collapsible frame lampshade of claim 1, wherein, the said middle frame can also comprise of a narrow-gauge rod bent into curved profile, with a stud disposed at the center of the top side, insertion ends formed at the bottom two sides, and a transverse post protruding laterally from each of the said insertion ends; the said stud at the top of the said middle frame is first inserted through a support ring at the center of an upper circular frame and then the said transverse posts at the bottom of the said middle frame are placed onto a support ring at the center of a lower circular frame to reinforce the separation of the said upper and lower circular frames, causing a pliant material to become taut and thereby constituting the sideless collapsible lampshade structure of the invention herein.

* * * * *